United States Patent [19]

Paizes

[11] Patent Number: 4,881,331

[45] Date of Patent: Nov. 21, 1989

[54] TEETH FOR USE WITH EARTH MOVING EQUIPMENT

[75] Inventor: George Paizes, Benoni, South Africa

[73] Assignee: Gamma Lock (Proprietary) Limited, Johannesburg, South Africa

[21] Appl. No.: 76,468

[22] Filed: Jul. 22, 1987

Related U.S. Application Data

[63] Continuation-in-part of Ser. No. 827,577, Feb. 10, 1986, abandoned.

[30] Foreign Application Priority Data

| | | | |
|---|---|---|---|
| Apr. 3, 1985 | [ZA] | South Africa | 85/2501 |
| Sep. 4, 1985 | [ZA] | South Africa | 85/6769 |
| Jan. 27, 1986 | [ZA] | South Africa | 86/8644 |
| Jun. 12, 1987 | [ZA] | South Africa | 87/4224 |

[51] Int. Cl.[4] ..... E02F 9/28

[52] U.S. Cl. ..... 37/142 A; 299/92; 37/141 R

[58] Field of Search ..... 37/142 R, 142 A, 141 T, 37/141 R; 172/713, 762, 753, 750; 299/92

[56] References Cited

U.S. PATENT DOCUMENTS

| | | | |
|---|---|---|---|
| 2,546,457 | 3/1951 | Launder | 37/142 A |
| 2,635,368 | 4/1953 | Hostetter | 37/142 |
| 2,852,874 | 9/1958 | Grubb | 37/142 |
| 3,106,256 | 10/1963 | McBride | 172/750 |
| 3,312,004 | 4/1967 | Johnson | 37/142 A |
| 3,312,504 | 4/1967 | Makinen | 299/92 X |
| 3,325,926 | 6/1967 | Wilson | 37/142 A |
| 3,879,867 | 4/1975 | Ericson | 37/142 A |
| 3,894,349 | 7/1975 | Moreau | 37/142 A |
| 4,247,147 | 1/1981 | Rettkowski | 37/142 A |
| 4,433,496 | 2/1984 | Jones et al. | 37/141 R |
| 4,508,468 | 4/1985 | Irwin | 403/328 |

FOREIGN PATENT DOCUMENTS

| | | | |
|---|---|---|---|
| 39316 | 8/1978 | Australia . | |
| 28449 | 5/1984 | Australia . | |
| 2930804 | 12/1981 | Fed. Rep. of Germany | 37/142 A |
| 1150034 | 7/1957 | France | 37/142 A |
| 1215839 | 12/1970 | United Kingdom . | |
| 1576535 | 10/1980 | United Kingdom . | |
| 1601207 | 10/1981 | United Kingdom . | |

*Primary Examiner*—Richard J. Johnson
*Attorney, Agent, or Firm*—Fulbright & Jaworski

[57] ABSTRACT

A shanked solid tooth for an excavator bucket. The shank in use fits into an adapter in the form of a tooth socket which is secured to a bucket. The shank has a transverse passage therethrough which is adapted to entirely receive a fastener therein. The fastener has a pair of pivoted fastening members biased apart by a resilient block which lock the tooth when it is forced into the adapter.

22 Claims, 3 Drawing Sheets

TEETH FOR USE WITH EARTH MOVING EQUIPMENT

Figure 1:
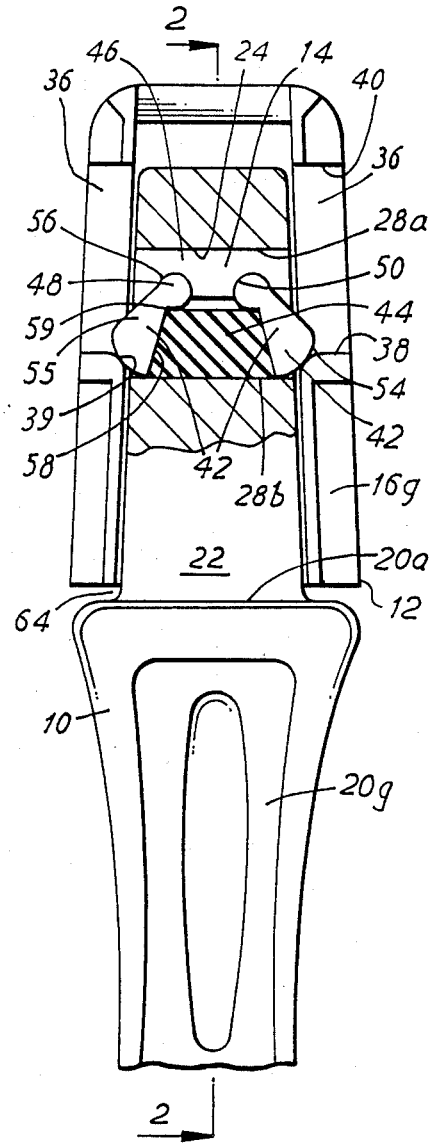

This application is a continuation in part of my copending patent application Ser. No. 827,577 filed Feb. 10, 1986 abandoned.

This invention relates to sacrificial teeth for use with earth moving equipment such as a bull-dozer, grader or ditcher.

BACKGROUND TO THE INVENTION

There are two main types of such teeth. There is a tooth which is largely hollow and which releasably fits on to an adapter in the form of a point. Such a tooth is hereinafter called a "hollow tooth". A second type of tooth has a solid working end and a root section that is secured to, for example, a bucket. Such a tooth is hereinafter called a "solid tooth".

A hollow tooth is generally fitted on to the adapter and is secured thereto by a fastener comprising a pin which passes through the point and is engaged by apertures in ears on the tooth which run alongside the adapter. Thus the adapter wll be the inner part and the tooth will be the outer part fitting thereon.

Solid teeth are generally in one of two forms. In one form, the root section is divided horizontally into two root parts between which is received the bucket and the root section is secured to the bucket by suitable fastener. This type of tooth is hereinafter called a "split solid tooth". A second form of solid tooth has a root section which fits into an adapter, in the form of a tooth socket, secured to the bucket. The root section has a transverse passage therethrough, and the adapter has a pair of side apertures which, when the root section is homed in the adapter, register or substantially register with the passage. The fastener is located within the passage and projects into the said side apertures to retain the root section within the tooth socket, the latter being the outer part surrounding the root section which constitutes the inner part. The latter tooth is hereinafter referred to as "a shanked solid tooth".

Originally solid teeth were split solid teeth and these were attached by being bolted on to the bucket. This is fairly satisfactory. However after the bucket has been used for some time, the threads on the bolts are burred over and generally sand and dirt packs onto the tooth making it extremely difficult to remove the bolts. To remove a worn tooth, therefore, it is usual to cut the bolts with an oxyacetylene cutter. This means that the earth moving equipment, which is a substantial and expensive piece of equipment has to be taken into the workshop to have the worn teeth cut off and to replace them with new teeth. As can be appreciated this is costly in down time of the equipment and there are difficulties in the cutting operation. Alternatively the oxy-acetylene cutter and necessary gas bottles have to be taken into the field which in practice was not satisfactory.

Subsequently, the shanked solid tooth and its assembly was provided as described in U.S. Pat. No. 3,879,867. In this arrangement, the fastening means comprises a rubber/steel key that secures the root section to the socket. This key comprises two steel members extending over the entire length of the key and having a rubber element therebetween. The key is wider than the side apertures and passage in the root. It is compressing the elastomeric element hammered into the side apertures through the socket and through the passage in the root. When the tooth has worn down, the key is hammered out and the stub of the tooth ca be removed. A similar system is shown in German Pat. No. 29 30 804

Another system for securing a shanked solid tooth the bucket comprises a set of pins and tubes.

A disadvantage of both the systems described in the preceeding two paragraphs is that the side apertures and the passage must be accurately dimensioned. Furthermore it is necessary to have at least one loose part in addition to the tooth. This can cause difficulties in the field as it may be that the contracter has teeth to affix to an earth moving apparatus but does not have available the necessary keys. It is an object of the invention to provide a more satisfactory fastener key for use with teeth.

In U.S. Pat. No. 3,312,504 there is disclosed a solid tooth with its shank split into two parts which are sprung away from each other. This tooth is designed for use with as an ice cutter tooth and is not positively located. Thus it can be removed by pulling it so that it will not be able to resist substantial forces as may be encountered in operation on earth moving equipment.

A large number of arrangements are provided with hollow teeth for quick engagement on to the adapter with spring loaded retention means. Typical arrangements are shown in U.S. Pat. Nos. 2,635,366; 3,106,256; 3,312,004; 3,325,926 and 4,433,496; French Pat. No. 1 150 034 and British Pat. No. 1 215 839. These known arrangements are complex to remove bearing in mind that not only must the retention means be depressed but at the same time a force must be applied, e.g. by a hammer, to force the tooth from the adapter. Tools that could be used are shown in the French Patent and U.S. Pat. No. 3,106,256. Also the retention means are often fairly insubstantial as in the French and British Patents and U.S. Pat. No. 3,106,256 or of considerable complexity as in U.S. Pat. Nos. 2,635,366 and 4,433,496. Other locking devices for teeth are illustrated in U.S. Pat. Nos. 2,852,874 and 4,247,147 but these do not appear to be positive locating devices and therefore have limited resistance to removal. In most if not all of the systems mentioned in this paragraph it appears to me that the items must be made with relatively small tolerances.

Various types of locking devices are of course known for other purposes as described for example in U.S. Pat. No. 4,508,468 and New Zealand Pat. No. 195389. However it is doubtful whether these can be applied in a practical manner to teeth for earth moving equipment.

SUMMARY OF THE INVENTION

It is an object of the present invention to provide a tooth for earth moving equipment which is relatively easy to apply to an adapter and to remove therefrom when the tooth has worn.

According to one aspect of the present invention there is provided a fastener means for a tooth for use with earth moving equipment comprising a pair of fastening members that have inner and outer ends and are mounted to pivot relative to one another about the inner ends from an inner position to an outer position and biassing means, preferably in the form of an elastomeric block, preferably comprising rubber or neoprene, to biass the members apart into their outer portions. In use the fastener will be inserted in a passage in the inner part prior to it being received in the outer part as defined above. When the fastening members are in the inner position, the inner part can be received in the outer part and when the fastening members are adjacent openings in the outer part, they will be biassed outwardly into the outer position so that one engages the sides of the openings and the other will act against a wall in the passage thereby to secure the inner part into the outer part.

Preferably the fastener further comprises an abutment member against which the said fastening members butt in such a way as to be able to pivot relative thereto, preferably the said members are provided with rounded ends and preferably the said abutment member has rounded recesses within which the said ends are received so as to be able to pivot as aforesaid. Preferably there are outer arms respectively outside the recesses and a land between the recesses, wherein the abutment plate is undercut below the arms. Further or alternatively the said fastening members may be provided with weaknesses so that when struck with a blow substantially at right angles thereto the members will tend to break so as to facilitate their removal of the fastener from the tooth and adapter.

Each fastening member preferably has a generally triangular projection with an inclined forward portion, the said weakness being provided near the rounded end. Each fastening member preferably has a notch in the front face to receive therein the said corner of the retaining walls when the root is homed in the adapter socket and the fastening members are in their outer positions.

The elastomeric element is preferably generally in the shape of the frustum of a triangle. It is preferably bonded to the said members preferably by being vulcanized thereto.

According to another aspect of the invention there is provided a shanked solid tooth having a working end and a root section having therethrough a transverse passage, and within the passage a fastener as set forth above, the arrangement being such that when the said fastening members are in their inner position, they are wholly or substantially wholly contained within the passage. Preferably the said root section is provided with holding means for holding the fastener within the passage. The holding members may comprise a pair of retaining walls at the side wall of the passage remote from the working end of the tooth and preferably one end of each of the fastening members is located within the retaining walls, the biassing means tending to biass the fastening members to pivot relative to one another about the said ends into the said outer positions. Preferably however, the retaining means comprises a projection from the passage and a recess in the elastomeric block into which the projection is received to prevent movement of the fastener transversely to the passage. Preferably too the fastener means further comprises an abutment member which is slidably located against the side of the passage remote from the working end and against which the said members butt in such a way as to be able to pivot relative to each other.

According to another aspect of the invention there is provided the combination of a shanked solid tooth or hollow tooth with an adapter therefor and a fastener as set forth above connecting the tooth to the adapter.

SHORT DESCRIPTION OF THE DRAWING

Figure 2:
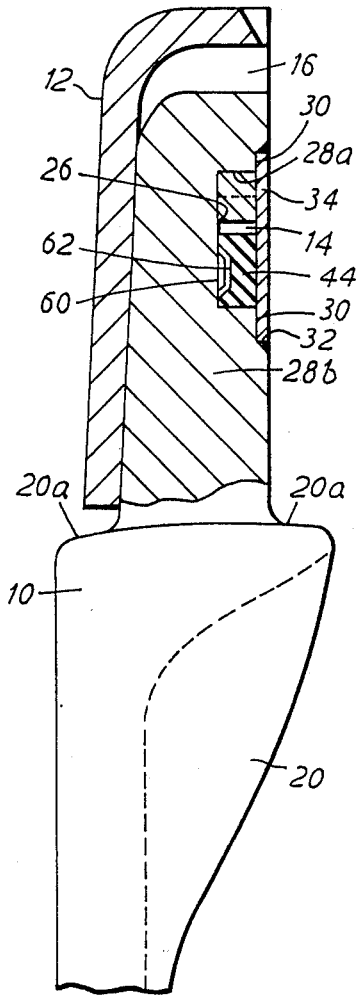
Figure 3:
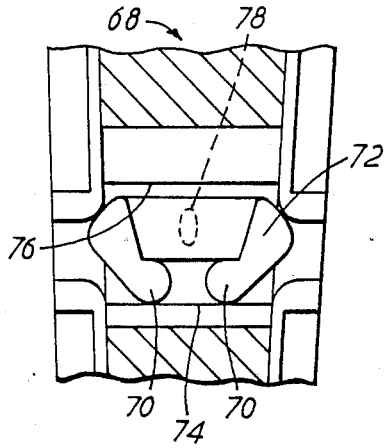
Figure 4:
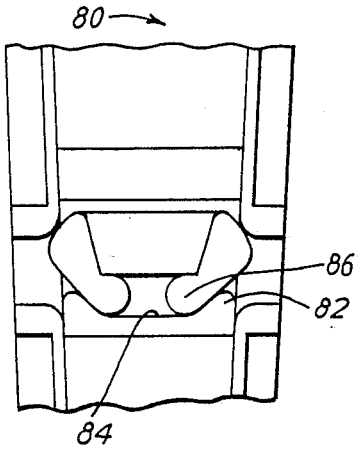
Figure 5:
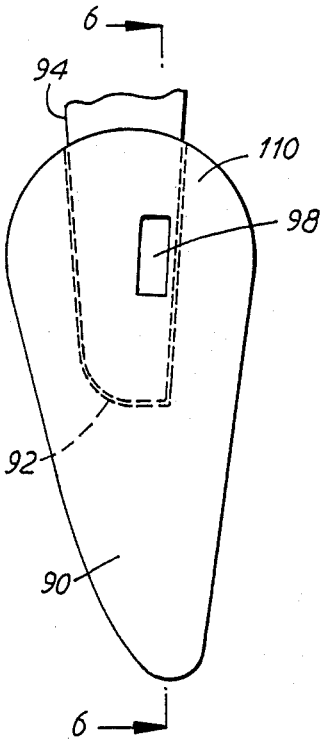
Figure 6:
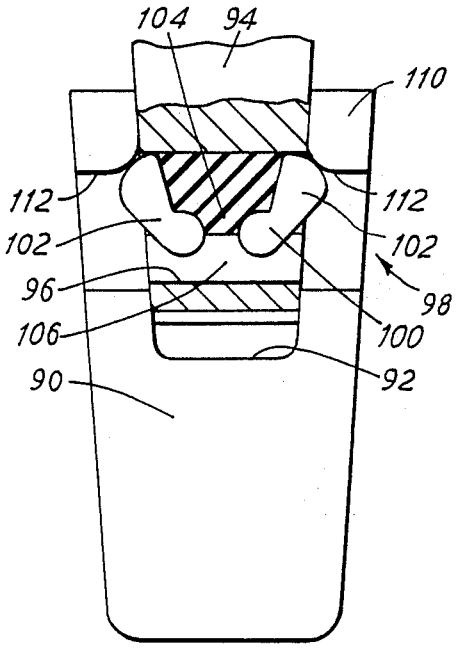
Figure 7:
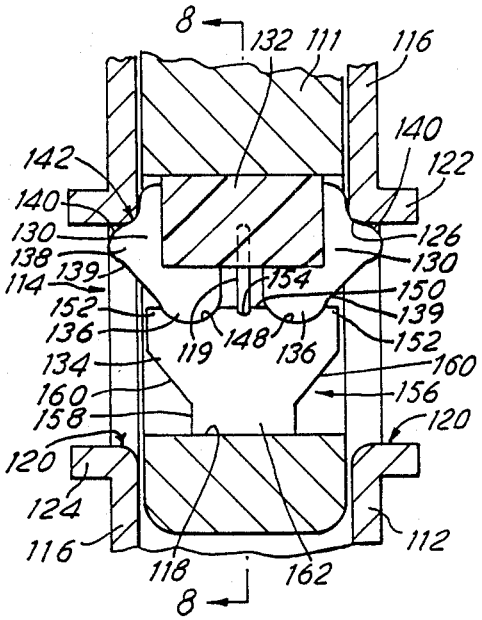
Figure 8:
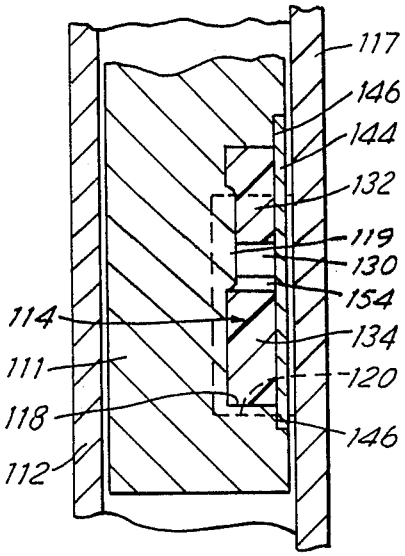
Figure 9:
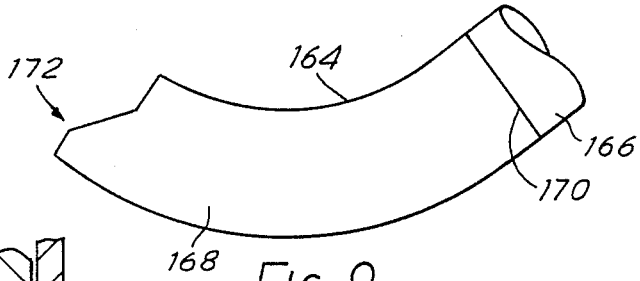
Figure 10:
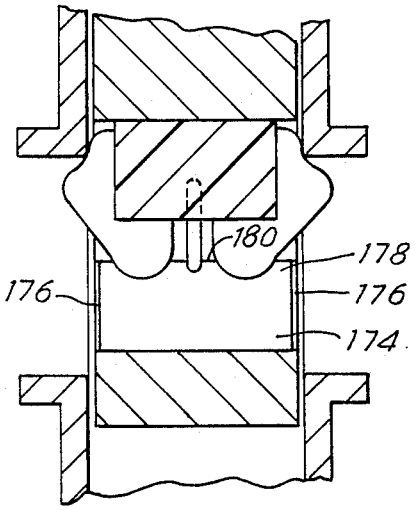

In the drawings:

FIG. 1 is an underplan view partially in section of a shanked solid tooth of the invention in position in an adapter socket, the side of the bucket and the cover place being omitted for clarity, FIG. 2 is a section on line 2—2 of FIG. 1, FIGS. 3 and 4 are detail underplan views of the root section of other solid shanked teeth of the invention, FIGS. 5 and 6 are respectively a side view of the rear of a hollow tooth of the invention and a section on line 6—6 of FIG. 5, FIG. 7 is a detail plan of a further embodiment of the invention, FIG. 8 is a section on line 8—8 of FIG. 7, FIG. 9 is a detail of a tool for use in removing a fastener from the arrangement of FIG. 7, and FIG. 10 is a view similar to FIG. 7 of yet a further embodiment of the invention.

DESCRIPTION OF A FIRST EMBODIMENT OF THE INVENTION

Referring now to FIGS. 1 and 2 there is shown a solid shanked tooth 10, an adapter in the form of a tooth socket 12 for receiving the tooth 10 as will be described, and a fastener 14 for retaining the tooth 10 in the adapter. The adapter socket 12 comprises a "U"-shaped member, the arms 16 of which are welded to the bottom plate of a bucket (not shown).

The tooth 10 has a spade-shaped working end 20 terminating in an inner or rear wall **20*a* from which extends a root section 22 which is received in the socket 12. The root section 22 has a transverse passage 24 therethrough. The passage 24 is defined by a recess having a base 26 and transversely extending plane side walls 28*a* and 28*b*. The passage is of increased width at its upper ends to form aligned paltforms 30 having end walls 32. A steel plate 34 rests on these platforms 30 to form a cover for the passage 24**.

The adapter socket 12 has a pair of aligned side apertures 36 formed by "U"-shaped cut-outs in the arms 16 and the plate 18. The side apertures 36 have longitudinally spaced end walls 38 and 40. The inner corner 39 of each wall 38 is rounded for the purpose which will become apparent. When the root section 22 is homed in the socket 12, these apertures 36 are adjacent to the passage 24.

The fastener 14 comprises a pair of aluminium fastening members 42, an elastomeric, neoprene or rubber, trapezoidal block 44, and an abutment plate 46. The block 44 is in the shape of the frustum of an isosocles triangle. It serves as a biassing means for the members 42 as will be described. The abutment piece 46 runs along the length of and slidably abuts against the side wall **28*a* of the passage 24 remote from the working end 20 of the tooth 10. The fastening members 42 run generally in the direction of the root portion 22. The ends 48 of the fastening members 42 ajacent the abutment plate 46 are rounded and are received within semi-circular recesses 50 in the abutment plate 46. The outer sides of the fastening members 42 have generally triangular projections 52 in shape each having its forward end wall 54 which is slightly rounded and which is inclined as will be described for the purposes that shall emerge and straight rear side wall 55. There is a neck or line of weakness 56 between the outer ends 48 and the thicker portions of the projections 52. The inner surfaces 58 of the fastening members 42 are flat over most of their length and butt against the sides of the block 46 which are vulcanized to these surfaces. At the junctions 59 between the ends 48 and the projections 52** and the ends 48 and the surfaces 58 only a very small radius or none at all, exists.

A low narrow longitudinally extending stud 60 is centrally located standing up from the base 26 of the passage 24. A longitudinal groove 62 is provided in the block 44 and this receives the stud 60. The engagement of the stud 60 in the groove 62 prevents the fastener 12 from moving transversely in the passage 24.

The elastomeric block 44 serves as a biassing means tending to biass the fastening members 42 to pivot relative to one another about their rounded ends 48 each from an inner position (shown in chain lines in FIG. 1) when the block is compressed, to an outer position (shown in full lines) when the block 44 is in its rest position.

When the fastening members 42 are in their inner positions, they lie substantially wholly within the passage 24. When the fastening members 42 are in their outer positions, the projections 52 project beyond the passage 24 to lie between the end walls 38 and 40 of the side apertures 36. The forward ends of the fastening members 42 however are wholly contained with the passage 24.

The forward end 54 of each projection 52 engages the wall 40 of the aperture closer to the working end 20 of the tooth.

The tooth 10 can easily be fitted into the socket 12 by feeding the root section 22 into the mouth 64 of the socket 12 until the rear walls 55 of the projections 52 engage the mouth. Further inward pressure will cause the walls 55 to swing the fastening members 42 inwards compressing the block 44 so that the fastening members 42 move into their inner positions enabling the root portion 22 to move into the socket 12. When the root portion 22 has homed into the socket 12 and the rear wall 20*a* butting against the mouth 56 of the socket 12, the projection 52 will be opposite the apertures 36. The block 44 will now biass the fastening members 42 outwardly into their outer positions so that the projections 52 enter the apertures 36 and the front walls 54 engage the rounded inner edge 39 of the end wall 38.

The root portion 22 will now be firmly held in place in the socket 12; rearward movement being inhibited by the engagement of the rear wall 20*a* of the working end 20 with the socket 12 and forward movement being inhibited by the engagement of the walls 54 of the fastening members 42 and the walls 38.

It will be noted that the angle of the front face of the end wall 54 is so chosen that any resultant force tending to remove the root portion 22 from the socket 12 will run directly along the length of each fastening member 42 through the centre of the portion 48 (or slightly inside it) on to the abutment plate 46. Very substantial compressive forces, which are in excess of any forces which would normally be encountered in practice, can thus be absorbed by the fastening members 42 so that the possibility of the tooth 10 being pulled out of the socket 16 is virtually non-existant.

Furthermore the shape of each of the front walls 54 and the rounded shape of the end wall 38 are such that forces emanating from the end wall 38 will not tend to pivot the fastening members 42 either inwardly or outwardly but will only be conveyed directly down the length of the fastening members as mentioned above.

When the working end 20 of the tooth 10 has worn down, the tooth 10 must be taken out of the socket 14. To do this, the fastener 14 must be removed which is effected by a sharp hammer blow being struck against the abutment plate 46 transversely the root section. This will tend to move the abutment plate 46 relative to the fastening members 42 and in turn to cause these to fracture along the lines of weakness 56. This is ensured because of the narrow neck and the sharp junctures 59 which latter form stress points. Also the elastomeric block 44 will tend to tear along a continuation of the groove 62. When this happens, the parts of the fastener 14 can simply be pushed out of the passage 26. The root portion 22 of the tooth 10 can now be removed from the socket 12, possibly with the assistance of a hammer blow on the inner end 68 of the root portion 22. A new tooth is now attached in the manner described above.

It will be noted that only hand pressure is normally needed to insert the root portion 22 into the socket 12 unless excessive dirt remains in the socket. Then a few light hammer blows would be all that is necessary for the purpose.

DESCRIPTION OF THE CURRENTLY PREFERRED EMBODIMENT OF THE INVENTION

Referrinng now to FIGS. 7 and 8 there is shown a part of the shank 111 of a solid shanked tooth, an adapter in the form of an adapter socket 112 for receiving the shank 111 and a fastener 114 for retaining the shank 111 in the adapter 112. The adapter socket 112 comprises a "U"-shaped member, the arms 116 of which are welded to the bottom plate of a bucket 117 (see FIG. 8).

The tooth which is substantially identical to the tooth 10 has inter alia a transverse passage 118 therethrough in which is received the fastener 114. A longitudinally extending, low rib 119 is formed on the base of the passage 118.

The adapter socket 112 is identical to the socket 12 and has a pair of aligned side apertures 120 formed by "U"-shaped cut-outs in the arms 116. The side apertures 120 have longitudinally spaced end walls 122 and 124. The inner corner 126 of each wall 122 is rounded. When the shank 111 is homed in the socket 112, these apertures 120 are adjacent to the passage 118.

The fastener 114 comprises a pair of metal fastening members 130, an elastomeric, rubber or neoprene, block 132 having a longitudinal groove in its underside to receive the rib 119, and a steel abutment plate 134. The fastening members 130 run generally in the direction of the shank 111. The inner ends 136 of the fastening members 130 (i.e. the ends adjacent the abutment plate 134) are rounded. The outer sides of the fastening members 130 have projections 38 which are generally triangular in shape each having its rear and forward end walls 139 and 140 lying at about 45° to the longitudinal axis of the shank 111. The forward end wall 140 is slightly rounded and a notch 142 is formed therein. A cover plate 144 covers the fastener means 114 being received on a shoulders 146 in the shank 111 at the front and rear of the opening 120. The cover plate 144 is welded in position.

The abutment plate 134 has on its front face a pair of spaced arcuate recesses 148 which receive the ends 136 in a way which permits them to pivot. The recesses 148 are spaced by a land 150 and there are a pair of arms 152 respectively on the outer sides of the recesses 148. Cut into front face of the land 150 is a groove 154 that receives the rib 119. The rear portion 156 of the abutment plate 134 is relieved at 158 at its ends behind the recesses 148 and has an inclined surface 160 so as to have an end portion 162 which is between 30% and 40%, conveniently 37%, of the maximum width of the plate 134.

A tool 164 (see FIG. 9) is provided to remove the shank. The tool 164 has a long shank 16 (only a part of which is shown) with a curved end portion 168 that is narrower than the tool shank 166 and is defined by a pair of shoulders 170 on either side. The end face 172 of the end portion 168 is slightly less wide than the abutment plate 134 and is shaped to mate with it. The end portion 168 is slightly less thick than the distance between the plate 148 and the base of the passage 118.

The shank 111 is inserted into the adapter socket 112 as described above, with the fastening means holding it in position. To remove the shank 111, the fastener 114 must first be removed. For this purpose, the end 170 of the tool 164 is inserted into the opening defined by the inclined surface 160, the base of the passage 118 and the coverplate 148 so that it butts against the end of the abutment plate 154. The curved part of the end portion 168 of the tool 162 rests against the rear corner 124 of the adapter at the opening 120. The end of the tool shank 166 is struck with a hammer and the force is applied to the side wall 160 causing the abutment plate 134 to move transversely to the shank 111. I have found that the abutment plate 134 is now pushed out of the passage 118. The fastening members 130 can be pulled out of the passage and the shank 111 removed in the normal way, possibly with some blows from a hammer and a drifter on the end of the shank if the latter has been jammed into the adapter as sometimes happens.

The way in which the fastener 114 is released is not fully understood at present. We believe however that the action is as follows:- As the abutment plate 134 is struck, the fastening member 130 nearer the tool ("the near member") is subject to a couple and pulls the far member through the medium of the block 132. At the same time, the far member additionally tends to rotate due to the pushing movement of the abutment plate 134 on the end 136 of that member. Consequently the front face 140 slides along the corner 126 of the opening wall 122 until it passes its end. The abutment plate 134 is then released as mentioned.

As in the arrangement described above the tooth can easily be fitted into the socket 112. Once the shank 110 is homed and the corner 126 is received within the notch 142, the fastening members 130 will be very securely engaged by the corner 112. Should there by any force on the tooth tending to draw it out of the socket 112, the force on the side 146 will be transmitted to the plate 134 as described above. There may in addition be an outward force tending to cause the fastening members 130 to swing further outwards. However the sides 144 of the notch 142 will engage the arm 116 preventing such swinging movement.

It will be noted that the forces on the abutment plate 134 in use will act inwardly so that they are accommodated by the part thereof which is solid. It will also be appreciated that if the tool is not available, a suitable drifter can be used for forcing the fastener from the passage 118.

DESCRIPTION OF A FURTHER PREFERRED EMBODIMENT

A modification shown in FIG. 10 is substantially identical to that illustrated in FIG. 8 save that the abutment plate 174 comprises aluminium and has end walls 176 running substantially parallel to the axis of the shank. When the end wall 176 of the abutment plate 174 is struck, the forces on the abutment plate 174 cause the arm 178 nearer the tool to break off. Also the rib 119 and the rounded end of the remote fastening member will distort and then break the centre land 180 so that the abutment plate 174 will be removed from the transverse passage. The remainder of the fastener can now easily be removed from the transverse opening 120. The tooth can now be removed.

DESCRIPTION OF FURTHER MODIFIED SOLID SHANKED TEETH OF THE INVENTION

In a modified arrangement of the invention, as shown in FIG. 3, a tooth 68 is provided wherein the abutment plate is omitted. Here the rounded ends 70 of the fastener members 72 butt directly against the side wall 74 of the root section 76, which wall 74 is remoted from the working end of the tooth 68.

A stud 78 which is similar to but larger than the stud 60 holds the fastener in position. This stud 78 can be broken on striking the fastener with a hammer and further blows will move it from the passage 76.

In a further tooth 80 of the invention (FIG. 4), the projection 60 from the base of the passage is omitted and narrow rims 82 from the side wall 84 bear against the rounded ends 86 of the fastening members 88. The rims 82 or one of them will break off when the fastener 88 is struck by a hammer blow as described above to permit removal of the fastener.

The teeth 68 and 80 are identical to tooth 10 other than for the features set out above.

DESCRIPTION OF A HOLLOW TOOTH OF THE INVENTION

As shown in FIGS. 5 and 6, a hollow tooth 90 has a hollow rear end 92 in which is received an adapter 94 in the form of a point. A transverse passage 96 is provided in through the adapter and in this is received a fastener 98.

The fastener 98 is a separate loose item but which is substantially identical to the fastener 12 including fastening members 100, having outer projections 102, and an elastomeric block 104 therebetween to which the members are vulcanized. The rounded ends of the members 100 are received in rounded recesses in an abutment plate 106. The inner end of the block 104 is also vulcanised to the abutment plate 106 thus creating a complete unit which holds together during normal handling.

The tooth 90 has ears 110 which lie on either side of the adapter 94. Each ear 110 has an aperture 112 which, when the tooth 90 is homed on to the adapter 94, is aligned with the passage 96.

The tooth has internal grooves extending from the ears 110 to the apertures 112, to receive the projections 102 as will be described.

In use, the fastener 98 is placed in the passage 96 and roughly centralised therein. The tooth 90 is now fitted on to the adapter 94 until grooves 114 engage the projections 102. Further pressure will compress the block 104 moving the fastening members 102 into their inner positions until the tooth 90 is homed on the adapter 94. Now the projections spring out under the bias of the block 104 to engage the apertures 112 and to hold the tooth 90 on the adapter 94. Removal of the fastener 98 is as described with reference to FIGS. 1 and 2.

GENERAL

I have found that each of the above described teeth of the invention can be easily fitted to its adapter. It can be easily removed therefrom as described above when the working end is worn down. Once fitted to its adapter it is held by the fastener firmly to prevent to its removal therefrom.

The invention can be used with advantage on all sizes of teeth from those having a mass of 2 kg. to 70 kg, or even more.

I have further found that the fasteners will be positively held in the passage of the shanked solid teeth so that they cannot be removed therefrom inadvertently. However the fastener can be readily removed as described above. This is because the fastening members in the embodiments of FIGS. 1 to 6 break relatively easily and quickly because of two features. First the material of which the fasteners are formed, i.e. aluminium, has a high compressive strength but low strength in shear. Second, as the fastening members have necks or weaknesses, failure takes place relatively easily when a sharp force is applied thereto as described. The arrangement of FIGS. 7 and 8 have the further advantages of the very secure engagement between the fastening members and the socket and the easier mode of removal of the fastener as is the case with the FIG. 10 embodiment.

I have found that the fastener of FIGS. 7 and 8 can hold the shank of the tooth firmly in the adapter socket even when working in very rough terrains, and yet it, the fastener, can be removed quickly—say a half to two minutes unless the opening 120 is very heavily packed with earth. This compares very favourably with the much longer time taken to remove the key in a known arrangement which has been observed to take up to eight minutes to remove.

Because the shanked solid tooth 10 is provided with a fastener 12 in the passage 24, it will not be necessary to carry separate fasteners 12 in stock. Of course this advantage does not apply with the hollow tooth of the invention.

The invention is not limited to the precise constructional details hereinbefore described and illustrated in the drawings. For example in the embodiment of FIG. 4, a single rim may engage in a central slot in the attached plate to hold the fastener in position. Suitable means may be provided to hold the fastener in the passage of the point adapter in the embodiment of FIGS. 5 and 6. This passage may be a groove on a surface of the adapter rather than a through passage. The fastening members may comprise other material having high compressive strength, but low strength in shear. The invention may also be used with drag line shovels and other ground engaging tools.

The shape of the steel abutment plate in the FIGS. 7 and 8 embodiment may be the same as that of the aluminium abutment plate in the FIG. 10 embodiment and vice versa. These abutment plates may also comprise cast iron or other suitable material. The land may be plane with the rib receiving groove 154.

Other changes and modifications may be made as will be apparent to those skilled in the art. The scope of the invention is defined only by the terms of the following claims.

What is claimed is:

1. A shanked solid tooth having (a) a shank which in use fits into an adapter in the form of a tooth socket secured to a bucket, the shank having therethrough a transverse passage, and (b) a fastener within the passage comprising (b.1) a pair of fastening members that have inner and outer ends and are pivot mounted relative to one another in a configuration to pivot about the inner ends from an inner position in which they are contained wholly or substantially wholly within the passage to an outer position in which said fastening members project out of the socket, and (b.2) biassing means to bias the fastener members apart from inner positions to the said outer positions.

2. A tooth as claimed in claim 1 wherein the fasteners further comprises an abutment member which is slidably located against one side of the passage and against which the said fastening members pivotally abut.

3. A tooth as claimed in claim 2 wherein the biassing means comprises an elastomeric block vulcanized to the fastening members and wherein there is provided a projection formed on the passage and a recess in the elastomeric block into which the projection is received to prevent movement of the fastening members in the passage.

4. A tooth as claimed in claim 1 in which the biassing means comprises an elastomeric block vulcanised to both the said members.

5. A tooth as claimed in claim 4 comprising retaining means for holding the fastening means within the passage, wherein the retaining means comprises a projection formed on the passage and a recess in the elastomeric block into which the projection is received to prevent movement of the fastening means in the passage.

6. The combination of a tooth member with an adapter member carrying the tooth member, one within the other, there being a passage through the inner of the said members and registering openings in the outer member, the combination further comprising a fastener within the passage, said fastener comprising a pair of fastening members that have inner and outer ends and are pivot mounted relative to one another in a configuration to pivot about the inner ends from an inner position in which they are contained wholly or substantially wholly within the passage to an outer position in which they project into the openings, and biassing means to bias the fastening members apart from said inner positions to said outer positions.

7. A tooth as claimed in claim 6 wherein said fastener further comprises an abutment member which is slidably located against one side of the passage and against which said fastener members butt in such a way as to be able to pivot relative thereto.

8. The combination comprising a tooth member, an adapter therefor, and fastening means for holding the tooth member to the adapter, in which (a) the adapter being in the form of a socket which is substantially "U"-shaped in section, has a mouth at an open end, and which has side arms with a pair of aligned openings therein defined by corner parts closer to the said mouth;

(b) the tooth having a root section that fits into the adapter, the root section having therethrough a transverse passage that is aligned with said openings when the root section fits in the adapter; and (c) the fastening means is received within said passage, said fastening means comprising:

(i) a pair of fastening members that have inner and outer ends and are pivot mounted and configured to pivot relative to one another about the inner ends from an inner position in which the fastening members are contained wholly or substantially wholly within the passage to an outer position in which said fastening members project into the openings and the said outer ends to abut against said corner parts, and (ii) biassing means connected to the members to bias the fastening members apart from the said inner positions to said outer positions.

9. The combination as claimed in claim 8 wherein the fastening means further comprises an abutment member which is slidably located against one side of the passage and against which the said inner ends of the fastening members butt in such a way as to be able to pivot relative thereto.

10. The combination of claim 9 further comprising a removal tool having a curved end part having an end surface which fits against the abutment member and moves it out of the passage.

11. The combination of claim 8 wherein each fastening member comprises a rounded inner end, a slightly rounded outer end, and a triangular projection on the side of the fastening member remote from said biassing means.

12. The combination of claim 11 in which each fastening member has a notch formed in the said outer end, the said notch in each fastening member receiving a said corner part of the adapter when the said outer end abuts thereagainst.

13. A shanked solid tooth having (a) a shank which in use fits into an adapter in the form of a tooth socket secured to a bucket, the shank having therethrough a transverse passage, and (b) a fastener within the passage comprising (b.1) an abutment member that is slidably located against one side of the passage, the abutment member having a surface remote from said one side of the passage with a pair of rounded recesses between laterally located arms and an area between the recesses, wherein said member being undercut below the arms, (b.2) A pair of fastening members that have inner and outer ends, the inner ends being rounded and being received respectively within the rounded recesses so that the fastening members can pivot relative to one another about the rounded inner ends from an inner position in which they are contained wholly or substantially wholly within the passage to an outer position in which said fastening members project out of the socket, and (b.3) biassing means to bias the fastening members apart from said inner positions to the said outer positions.

14. A tooth as claimed in claim 13 wherein the said shank is provided with retaining means for holding the fastening members within the passage.

15. The combination of a tooth member, an adapter therefor, and fastening means holding the tooth member to the adapter, in which (a) the adapter is in the form of a socket which is substantially "U"-shaped in section, the socket having:

(i) a mouth at an open end of the socket, and (ii) side arms with a pair of aligned openings therein defined by corner parts closer to said mouth;

(b) the tooth has a root section which fits into the adapter, the root section having therethrough a transverse passage that is aligned with the said openings when the root section fits in the adapter; and (b) the fastening means is received within the passage, the said fastening means comprising:

(i) an abutment member that is slidably located against one side of the passage, the abutment member having a surface remote from said one side of the passage with a pair of rounded recesses therein and an area between the recesses, wherein said recesses are located between outer arms of said abutment member wherein said member being undercut below the arms, (ii) a pair of fastening members that have inner and outer ends, said inner ends being rounded and being received respectively within said rounded recesses so that the fastening members can pivot relative to one another about said rounded inner ends from an inner position in which said fastening members are contained wholly or substantially wholly within the passage to an outer position in which said fastening project into the openings and the said outer ends to abut against the said corner parts, and (ii) biassing means connected to the fastening members to bias the fastening members apart from the said inner positions to the said outer positions.

16. A fastener for a tooth for use with earth moving equipment comprising:

(a) a pair of fastening members that have inner and outer ends;

(b) an abutment member against which said inner ends of said fastening members butt in such a way as to be able to pivot relative to one another about the inner ends from an inner position to an outer position; and (c) a biassing device engaging and biassing said fastening members apart from said inner positions to said outer positions.

17. A tooth as claimed in claim 16 in which each fastening member comprises a rounded inner end, a slightly rounded forward end, and a triangular projection on the side of the fastening member remote from the elastomeric block.

18. A tooth as claimed in claim 17 in which each fastening member has a notch formed in the said forward end.

19. A fastener as claimed in claim 16 wherein the said inner ends of the fastening members are rounded and wherein said abutment member has rounded recesses within which said rounded ends are received so as to be able to pivot.

20. A fastener as claimed in claim 19 in which there are outer arms respectively outside the recesses and an area between the recesses, and in which the abutment plate is undercut below the arms.

21. A fastener as claimed in claim 16 wherein said fastening members are provided with weaknesses so that when struck with a blow at right angles the fastening members break so as to facilitate the removal of the key from the tooth and adapter.

22. A tooth as claimed in claim 21 in which each fastening member comprises an enlarged rounded inner end, a slightly rounded forward end, and a triangular projection on the side of the fastening member remote from the elastomeric block, the weakness being provided by a neck formed between said triangular projection and said rounded inner end.

* * * * *